US008871331B2

(12) United States Patent
Seth

(10) Patent No.: US 8,871,331 B2
(45) Date of Patent: Oct. 28, 2014

(54) ANTI-LOADING ABRASIVE ARTICLE

(75) Inventor: Anuj Seth, Marlborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 128 days.

(21) Appl. No.: 12/977,028

(22) Filed: Dec. 22, 2010

(65) Prior Publication Data

US 2011/0165364 A1 Jul. 7, 2011

Related U.S. Application Data

(60) Provisional application No. 61/290,769, filed on Dec. 29, 2009.

(51) Int. Cl.

| | |
|---|---|
| ***B42D 15/00*** | (2006.01) |
| ***B42D 11/00*** | (2006.01) |
| ***B32B 3/02*** | (2006.01) |
| ***B32B 5/00*** | (2006.01) |
| ***B32B 7/00*** | (2006.01) |
| ***B24B 37/26*** | (2012.01) |
| ***B24D 11/00*** | (2006.01) |
| ***B24B 37/24*** | (2012.01) |

(52) U.S. Cl.

CPC ..... *B24B 37/245* (2013.01); *B24B 37/26* (2013.01); *B24D 11/001* (2013.01)

USPC ..... 428/195.1; 428/64.1; 428/98; 51/297; 51/295; 451/523

(58) Field of Classification Search

CPC ..... B24B 37/245; B24B 5/00; B24B 19/00; B24B 19/001; B24B 19/08; B24D 3/00; B24D 5/00; A47L 13/28; A47L 13/10

USPC ..... 451/59, 533, 534, 537, 539, 527, 542

See application file for complete search history.

(56) References Cited

U.S. PATENT DOCUMENTS

| | | | |
|---|---|---|---|
| 3,991,527 | A | 11/1976 | Maran |
| 5,108,463 | A | 4/1992 | Buchanan |

(Continued)

FOREIGN PATENT DOCUMENTS

| | | | |
|---|---|---|---|
| CN | 101126012 | A | 2/2008 |
| WO | 2008063599 | A2 | 5/2008 |
| WO | 2011/090681 | A2 | 7/2011 |

OTHER PUBLICATIONS

Thomson Innovation, "Patent Result Set", 8 pages.

(Continued)

*Primary Examiner* — Mark Ruthkosky
*Assistant Examiner* — Laura C Powers
(74) *Attorney, Agent, or Firm* — Joseph P. Sullivan; Abel Law Group, LLP

(57) ABSTRACT

A coated abrasive article includes a backing having a surface, a plurality of abrasive regions overlying the surface in each of the first and second portions, and at least one macro-channel. The surface of the backing has a shape defined by an outer contour. A bisecting axis divides the shape into first and second portions. Each abrasive region includes a binder and a plurality of abrasive grains in contact with the binder. The abrasive grains have an average grain size of not greater than about 200 microns. The at least one macro-channel defines a passageway extending between a pair of adjacent abrasive regions and terminating at openings at the outer contour within each of the first and second portions. The macro-channel has an average channel width of between about 0.1 millimeters to about 5 millimeters and is substantially free of the binder and the abrasive grains.

13 Claims, 4 Drawing Sheets

(56) References Cited

U.S. PATENT DOCUMENTS

| | | | | |
|---|---|---|---|---|
| 5,137,542 | A | 8/1992 | Buchanan et al. | |
| 5,152,917 | A | 10/1992 | Pieper et al. | |
| 5,251,802 | A | 10/1993 | Bruxvoort et al. | |
| 5,254,802 | A | 10/1993 | Hoekstra et al. | |
| 5,328,716 | A | 7/1994 | Buchanan | |
| 5,417,726 | A | 5/1995 | Stout et al. | |
| 5,489,233 | A | 2/1996 | Cook et al. | |
| 5,505,747 | A | 4/1996 | Chesley et al. | |
| 5,542,875 | A | 8/1996 | Ichiguchi | |
| 5,542,876 | A | 8/1996 | Field, Jr. | |
| 5,560,753 | A | 10/1996 | Schnabel et al. | |
| 5,565,011 | A | 10/1996 | Follett et al. | |
| 5,573,619 | A | 11/1996 | Benedict et al. | |
| 5,700,302 | A | 12/1997 | Stoetzel et al. | |
| 6,280,824 | B1 | 8/2001 | Insley et al. | |
| 6,537,140 | B1 | 3/2003 | Miller et al. | |
| 6,923,840 | B2 | 8/2005 | Schutz et al. | |
| 6,979,248 | B2 | 12/2005 | Hu et al. | |
| 6,986,706 | B1 * | 1/2006 | Cooper et al. | 451/527 |
| 7,118,457 | B2 | 10/2006 | Swedek et al. | |
| 7,169,029 | B2 * | 1/2007 | Petersen et al. | 451/523 |
| 2003/0022604 | A1 * | 1/2003 | Annen et al. | 451/59 |
| 2004/0180618 | A1 | 9/2004 | Suzuki et al. | |
| 2006/0135050 | A1 | 6/2006 | Petersen et al. | |
| 2007/0066186 | A1 | 3/2007 | Annen et al. | |

OTHER PUBLICATIONS

Search Results, "X5346 Additional Patents on No-fill Patents", 20 pages.

Search Results, "X5347: Patents on coated abrasive articles with dust removal means (Perforations)", 46 pages.

International Search Report from PCT Application No. PCT/US2010/061943, dated Aug. 19, 2011.

* cited by examiner

ANTI-LOADING ABRASIVE ARTICLE

CROSS-REFERENCE TO RELATED APPLICATION(S)

The present application claims priority from U.S. Provisional Patent Application No. 61/290,769, filed Dec. 29, 2009, entitled "ANTI-LOADING ABRASIVE ARTICLE," naming inventor Anuj Seth, which application is incorporated by reference herein in its entirety.

FIELD OF THE DISCLOSURE

The present disclosure generally relates to abrasives, and more particularly relates to anti-loading abrasive articles.

BACKGROUND

Abrasive articles, such as coated abrasive articles, are used in various industries to machine work pieces, such as by lapping, grinding, or polishing. Machining utilizing abrasive articles spans a wide industrial scope from optics industries, automotive paint repair industries, to metal fabrication industries. Machining, such as by hand or with use of commonly available tools such as orbital polishers (both random and fixed axis), and belt and vibratory sanders, is also commonly done by consumers in household applications. In each of these examples, abrasives are used to remove bulk material and/or affect surface characteristics of products (e.g., planarity, surface roughness). Additionally, various types of automated processing systems have been developed to abrasively process articles of various compositions and configurations.

Surface characteristics include shine, texture, and uniformity. In particular, surface characteristics, such as roughness and gloss, are measured to determine quality in the automotive paint repair industries. For example, when painting a surface, paint is typically sprayed on the surface and cured. The resulting painted surface has a pock marked orange peel texture or encapsulated dust defects. Typically, the painted surface is first sanded with a coarse grain abrasive and subsequently, sanded with fine grain engineered abrasives and buffed with wool or foam pads. Hence, the abrasive surface of the abrasive article generally influences surface quality.

In addition to the surface characteristics, industries such as the automotive painting industry are sensitive to cost. Factors influencing the operational cost include the speed at which a painted surface can be prepared and the cost of the materials used to prepare that surface. Typically, the industry seeks cost effective materials having high material removal rates.

However, abrasives that exhibit high removal rates often exhibit poor performance in achieving desirable surface characteristics. Conversely, abrasives that produce desirable surface characteristics often have low material removal rates. For this reason, preparation of a painted surface is often a multistep process using various grades of abrasive sheets. Typically, surface flaws introduced by one step are repaired using finer grain abrasives in a subsequent step. As such, abrasives that introduce fine scratches and surface flaws result in increased efforts in subsequent steps.

Typically, any increase in effort in any one step results in increased costs. For example, increased efforts include increased time utilized to improve the surface quality and an increased number of abrasive products used during that step. Both an increased time and an increased number of abrasive products used in a step lead to increased costs, resulting in disadvantages in the marketplace.

As such, a cost effective abrasive article that provides improved surface characteristics when used would be desirable.

SUMMARY

In an embodiment, a coated abrasive article can include a backing having a surface. The surface can have a shape defined by an outer contour. A bisecting axis can divide the shape into first and second portions. The coated abrasive article can further include a plurality of abrasive regions overlying the surface in each of the first and second portions. Each abrasive region can include an adhesive layer and a plurality of abrasive grains in contact with the adhesive layer. The abrasive grains can have an average grain size of not greater than about 200 microns. The coated abrasive article can further include at least one macro-channel defining a passageway extending between a pair of adjacent abrasive regions and terminating at openings at the outer contour within each of the first and second portions. The at least one macro-channel can have an average channel width of between about 2.5 microns to about 125000 microns and can be substantially free of the adhesive layer and the abrasive grains.

In another embodiment, a coated abrasive article can include a backing having a surface. The surface can have a geometric shape defined by an outer contour. A bisecting axis can divide the geometric shape into first and second equal portions. The coated abrasive article can further include a plurality of abrasive regions overlying the backing in each of the first and second portions and at least one macro-channel defining a passageway extending between a pair of adjacent abrasive regions and terminating at openings at the outer contour within each of the first and second portions. Each abrasive region can include an adhesive layer and a plurality of abrasive grains in contact with the adhesive layer. The macro-channel being substantially free of the adhesive layer and the abrasive grains. The ratio of the average channel width of the abrasive grains to the square root of the average grain size of the macro-channel can be between about 250 to about 750.

In yet another embodiment, a method of forming a abrasive article can include coating a backing with an adhesive, applying an abrasive grain to the adhesive, curing the adhesive to form a coated abrasive, and applying the coated abrasive to a back pad to form first and second abrasive regions. At least one macro-channel can define a passageway extending between the first and second abrasive regions and can terminate at openings at an outer contour of the coated abrasive article. The macro-channel can be substantially free of the adhesive layer and the abrasive grains.

In a further embodiment, a method of forming a coated abrasive article can include selectively coating a backing with an adhesive so as to form coated regions with uncoated regions therebetween, applying an abrasive grain to the adhesive, and curing the adhesive. The uncoated regions can correspond to at least one macro-channel defining a passageway extending between adjacent coated regions and terminating at openings at an outer contour of the coated abrasive article.

In still another embodiment, a method of abrading a work piece can include contacting the work piece with a coated abrasive, rotating the coated abrasive relative to the work piece at a first rotational speed to remove material from the work piece. The coated abrasive can include first and second abrasive regions and a macro-channel formed between the first and second abrasive regions. The macro-channel can define a passageway extending between the first and second abrasive regions and can terminate at openings at an outer contour of the coated abrasive article. The method can further include accelerating the coating abrasive from the first rotational speed to a second rotational speed, ejecting the material from the macro-channels at the second rotational speed, and decelerating the coated abrasive from the second rotational speed to the first rotational speed to remove additional material from the work piece.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

In an embodiment, a coated abrasive article can include a backing, a plurality of abrasive regions overlying the backing, and at least one macro-channel defining a passageway extending between a pair of adjacent abrasive regions. The macro-channel can terminate at openings at an outer contour of the coated abrasive article.

Figure 1:
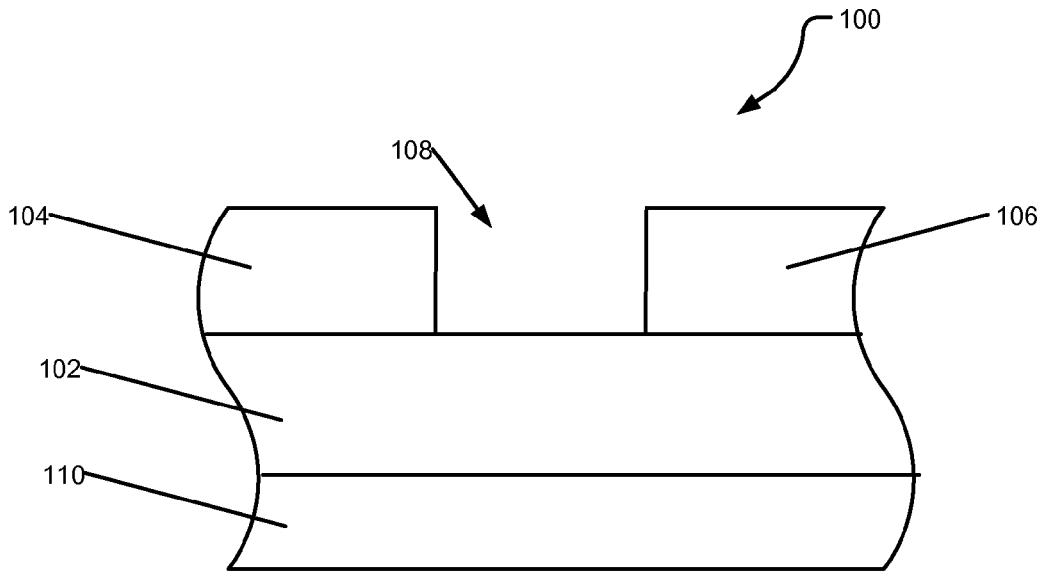
FIGS. 1 through 3 are cross-section views illustrating exemplary abrasive articles in accordance with embodiments of the present disclosure.

FIG. 1 shows a cross section of a coated abrasive article 100. Coated abrasive article 100 can include a backing 102 and abrasive regions 104 and 106 overlying backing 102. Macro-channel 108 can be between abrasive regions 104 and 106. In a particular embodiment, coated abrasive article 100 can optionally include a backpad 110.

Figure 2:
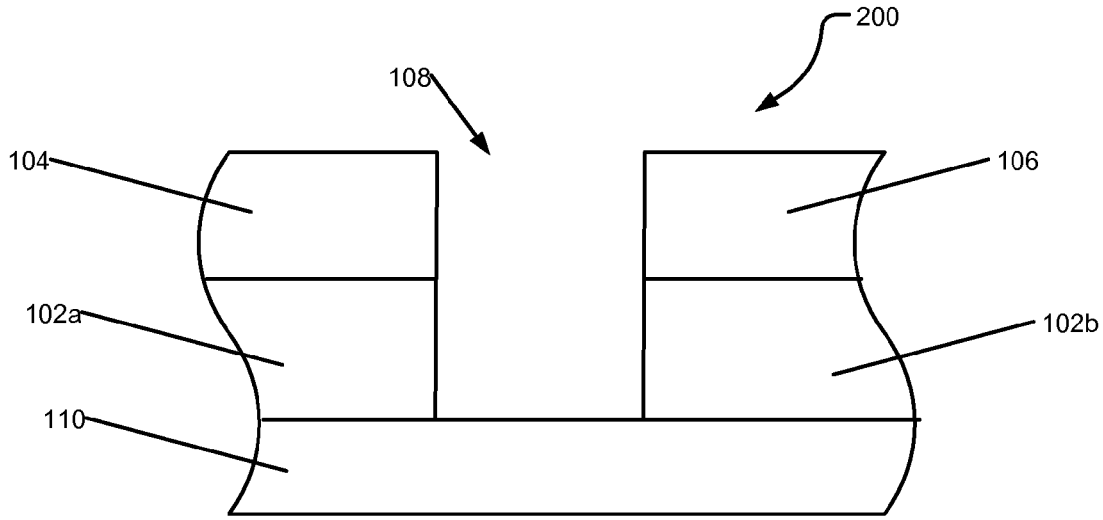

FIG. 2 shows a cross section of another coated abrasive article 200. Coated abrasive article 200 can include a backing regions 102*a* and 102*b* overlying backpad 110. Abrasive regions 104 and 106 can overlie backing regions 102*a* and 102*b*. Macro-channel 108 can extend between backing region 102*a* and abrasive regions 104 and backing regions 102*b* and abrasive region 106.

Figure 3:
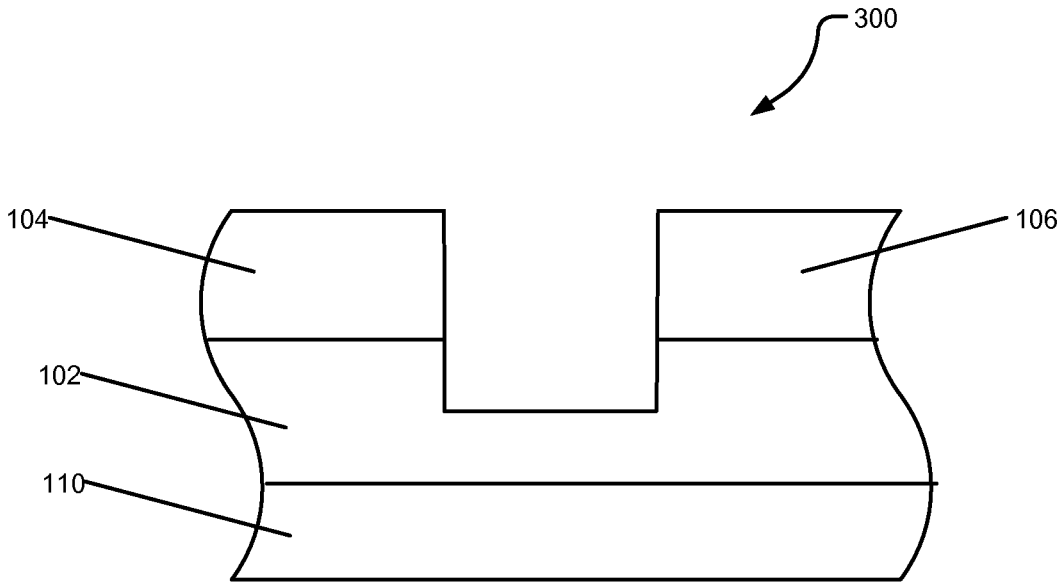

FIG. 3 shows a cross section of yet another coated abrasive article 300. Coated abrasive article 100 can include a backing 102 and abrasive regions 104 and 106 overlying backing 102. Macro-channel 108 can extend between abrasive regions 104 and 106 and at least partially into backing 102. For example, a pattern corresponding to macro-channel can be embossed into backing 102 and abrasive regions 104 and 106 can be formed over backing 102. In a particular embodiment, coated abrasive article 100 can optionally include a backpad 110.

Backing 102 can be flexible or rigid. Backing 102 may be made of any number of various materials including those conventionally used as backings in the manufacture of coated abrasives. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton or rayon); paper; vulcanized paper; vulcanized rubber; vulcanized fiber; nonwoven materials; a combination thereof; or a treated version thereof. Cloth backings may be woven or stitch bonded. In particular examples, the backing is selected from the group consisting of paper, polymer film, cloth, cotton, poly-cotton, rayon, polyester, poly-nylon, vulcanized rubber, vulcanized fiber, metal foil and a combination thereof. In other examples, the backing includes polypropylene film or polyethylene terephthalate (PET) film.

Backing 102 may optionally have at least one of a saturant, a presize layer or a backsize layer. The purpose of these layers is typically to seal the backing or to protect yarn or fibers in the backing. If the backing 102 is a cloth material, at least one of these layers is typically used. The addition of the presize layer or backsize layer may additionally result in a "smoother" surface on either the front or the back side of the backing. Other optional layers known in the art may also be used (for example, a tie layer; see U.S. Pat. No. 5,700,302 (Stoetzel et al.), the disclosure of which is incorporated by reference).

An antistatic material may be included in a cloth treatment material. The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.), the disclosures of which are incorporated herein by reference.

The backing may be a fibrous reinforced thermoplastic such as described, for example, in U.S. Pat. No. 5,417,726 (Stout et al.), or an endless spliceless belt, as described, for example, in U.S. Pat. No. 5,573,619 (Benedict et al.), the disclosures of which are incorporated herein by reference. Likewise, the backing may be a polymeric substrate having hooking stems projecting therefrom such as that described, for example, in U.S. Pat. No. 5,505,747 (Chesley et al.), the disclosure of which is incorporated herein by reference. Similarly, the backing may be a loop fabric such as that described, for example, in U.S. Pat. No. 5,565,011 (Follett et al.), the disclosure of which is incorporated herein by reference.

Abrasive regions 104 and 106 may be formed as one or more coats. For example, the abrasive regions may include a make coat and optionally a size coat. Abrasive regions 104 and 106 generally include abrasive grains and a binder. The abrasive grains can include essentially single phase inorganic materials, such as alumina, silicon carbide, silica, ceria, and harder, high performance superabrasive grains such as cubic boron nitride and diamond. Additionally, the abrasive grains can include composite particulate materials. Such materials can include aggregates, which can be formed through slurry processing pathways that include removal of the liquid carrier through volatilization or evaporation, leaving behind green aggregates, optionally followed by high temperature treatment (i.e., firing) to form usable, fired aggregates. Further, the abrasive regions can include engineered abrasives including macrostructures and particular three-dimensional structures.

In an exemplary embodiment, the abrasive grains are blended with the binder formulation to form abrasive slurry. Alternatively, the abrasive grains are applied over the binder formulation after the binder formulation is coated on the backing Optionally, a functional powder may be applied over the abrasive regions to prevent the abrasive regions from sticking to a patterning tooling. Alternatively, patterns may be formed in the abrasive regions absent the functional powder.

The binder of the make coat or the size coat may be formed of a single polymer or a blend of polymers. For example, the binder may be formed from epoxy, acrylic polymer, or a combination thereof. In addition, the binder may include filler, such as nano-sized filler or a combination of nano-sized filler and micron-sized filler. In a particular embodiment, the binder is a colloidal binder, wherein the formulation that is cured to form the binder is a colloidal suspension including particulate filler. Alternatively, or in addition, the binder may be a nanocomposite binder including sub-micron particulate filler.

The coated abrasive article may optionally include compliant and back coats (not shown). These coats may function as described above and may be formed of binder compositions.

The binder generally includes a polymer matrix, which binds abrasive grains to the backing or compliant coat, if present. Typically, the binder is formed of cured binder formulation. In one exemplary embodiment, the binder formulation includes a polymer component and a dispersed phase.

The binder formulation may include one or more reaction constituents or polymer constituents for the preparation of a polymer. A polymer constituent may include a monomeric molecule, a polymeric molecule, or a combination thereof. The binder formulation may further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents may include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation may include a monomer, an oligomer, a polymer, or a combination thereof. In a particular embodiment, the binder formulation includes monomers of at least two types of polymers that when cured may crosslink. For example, the binder formulation may include epoxy constituents and acrylic constituents that when cured form an epoxy/acrylic polymer.

The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, and a blend thereof. Particular embodiments have been created by use of dense abrasive grains comprised principally of alpha-alumina.

The abrasive grain may also have a particular shape. An example of such a shape includes a rod, a triangle, a pyramid, a cone, a solid sphere, a hollow sphere, or the like. Alternatively, the abrasive grain may be randomly shaped.

In an embodiment, the abrasive grains can have an average grain size not greater than 200 microns, such as not greater than about 150 microns. In another example, the abrasive grain size is not greater than about 100 microns, such as not greater than about 75 microns, even not greater than about 50 microns. For example, the abrasive grain size may be at least 0.1 microns, such as from about 0.1 microns to about 200 microns, and more typically from about 0.1 microns to about 150 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

Abrasive regions 104 and 106 may further include a grinding aid to increase the grinding efficiency and cut rate. A useful grinding aid can be inorganic based, such as a halide salt, for example, sodium cryolite, and potassium tetrafluoroborate; or organic based, such as a chlorinated wax, for example, polyvinyl chloride. A particular embodiment includes cryolite and potassium tetrafluoroborate with particle size ranging from 1 micron to 80 microns, and most typically from 5 microns to 30 microns. In an embodiment, abrasive regions 104 and 106 may further include a supersize coat. The super size coat can be a polymer layer applied over the abrasive grains to provide anti-glazing and anti-loading properties.

Abrasive regions 104 and 106 can have a thickness of at least about 2.5 microns. In an embodiment, abrasive regions 104 and 106 can include an engineered abrasive and can have thickness of not greater than about 5000 microns. In another embodiment, the thickness of abrasive regions 104 and 106 can be not greater than about 1250 microns.

In an embodiment, macro-channel 108 can be substantially free of binder and abrasive grains. Additionally, the surface of backing 102 or backpad 110 at the base of macro-channel 108 can be substantially free of binder and abrasive grains. In an example, macro-channel 108 can have a rectangular cross section having a width and a depth. The depth can be least about 2.5 microns. In an embodiment, the depth can be not greater than about 5000 microns, such as not greater than about 2500 microns, even not greater than about 1250 microns. Further, in embodiments where macro-channel 108 extends partially into but not completely through backing 102, such as shown in FIG. 3, macro-channel 108 can extend into backing 102 to a thickness of at least about 2.5 microns and not greater than about 2500 microns.

When included, backpad 110 can be flexible or rigid. Backpad 110 may be made of any number of various materials including those conventionally used in the manufacture of coated abrasives. An exemplary flexible backpad includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton or rayon); paper; vulcanized paper; vulcanized rubber; vulcanized fiber; nonwoven materials; a combination thereof; or a treated version thereof. Cloth backpads may be woven or stitch bonded. In particular examples, the backpad can be a foam, a vulcanized rubber, or any combination thereof.

Backpad 110 may be a fibrous reinforced thermoplastic such as described, or an endless spliceless belt. Likewise, backpad 110 may be a polymeric substrate having hooking stems projecting therefrom. Similarly, the backpad 110 may be a loop fabric.

Figure 4:
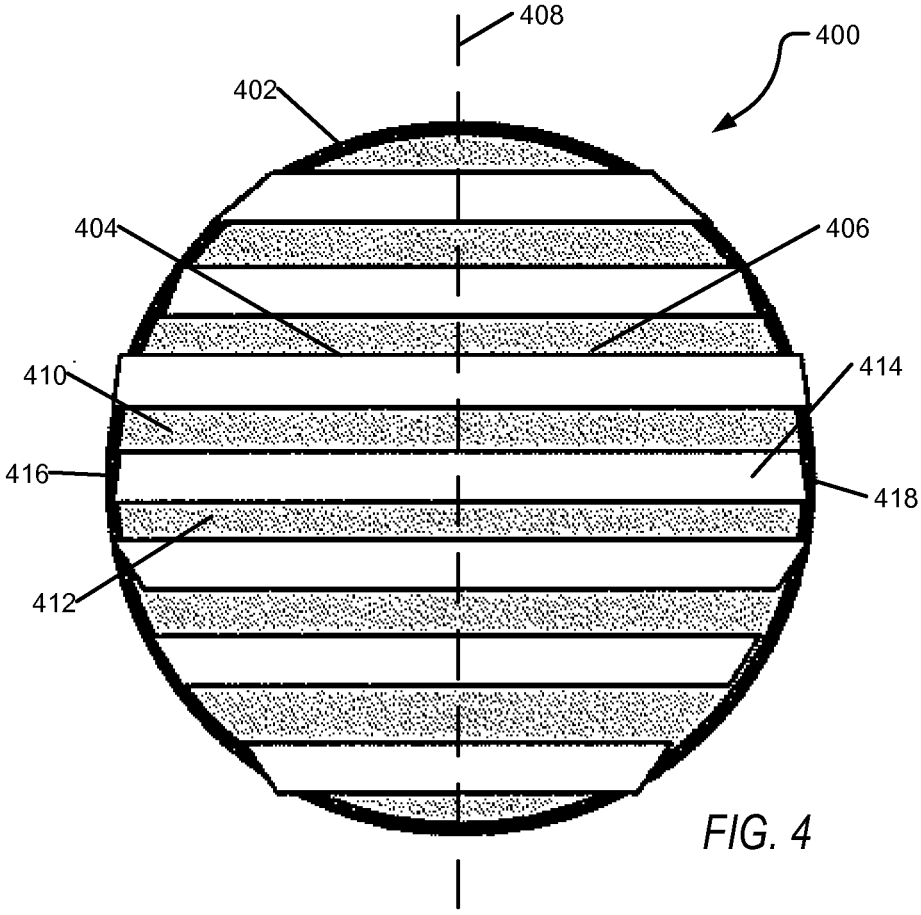
FIGS. 4 through 7 are top views illustrating exemplary abrasive articles in accordance with embodiments of the present disclosure.

FIG. 4 is a top-down view illustrating a working surface 400 of a coated abrasive article, such as coated abrasive article 100. Surface 400 can have an outer contour 402 defining the overall shape of surface 400. The shape can be a circle, as shown. In alternate embodiments, the surface 400 can have a shape other than a circle, such as a rectangle, a square, a regular polygon, an irregular polygon, or the like. The shape can be divided into portion 404 and 406 by a bisecting axis 408.

Abrasive regions 410 and 412 can overlie the surface. Abrasive regions 410 and 412 can have a length, corresponding to the longest dimension along surface 400 and a width perpendicular to the length and along surface 400. The width of abrasive regions 410 and 412 can be at least about 2.5 microns. Additionally, the width of abrasive regions can be not greater than about 50000 microns (50 millimeters). In an embodiment, the width of the abrasive regions can be at least about 5000 microns (5 millimeters) and not greater than about 15000 microns (15 millimeters).

Macro-channel 414 can extend between abrasive regions 410 and 412. Additionally, macro-channel 414 can terminate at outer contour 402 of portion 404 at opening 416 and at outer contour 402 of portion 406 at opening 418. Macro-channel 414 can be rectilinear, as shown. Alternatively, macro-channel 414 can include an arcuate portion. The arcuate portion can have a substantially constant radius of curvature or can have a variable radius of curvature, such as a spiral. Macro-channel 414 can have a length corresponding to the longest dimension along surface 400 and a width perpendicular to the length and along surface 400. Generally, macro-channel 414 can have an average width of at least about 2.5 microns. In embodiments, macro-channel 414 can have an average width of at least about 500 microns (0.5 millimeters), such as at least about 1000 microns (1 millimeter), even at least 1500 microns (1.5 millimeters).

In an embodiment, the macro-channel can have a uniform width along substantially the entire length of the macro-channel. In an alternate embodiment, the macro-channel can have a variable width. The width of the macro-channel can increase going from the center of the abrasive to the openings. Alternatively, the width of the macro-channel can decrease going from the center of the abrasive towards the opening. Further, the width of the macro-channel can increase linearly or non-linearly along the length of the macro-channel. In particular, the cross section of the macro-channel can be shaped to optimize the amount of swarf that is ejected from the abrasive.

In an embodiment, the width of the macro-channel can be related to the average grain size. Specifically, the ratio of the average channel width to the square root of the average grain size can be at least about 250, such as at least about 300, such as at least about 350, such as at least about 400, even at least about 450. Additionally, the ratio of the average channel width to the square root of the average grain size can be not greater than about 750, such as not greater than about 700, such as not greater than about 650, such as not greater than about 600, such as not greater than about 550, even not greater than about 500.

Figure 5:
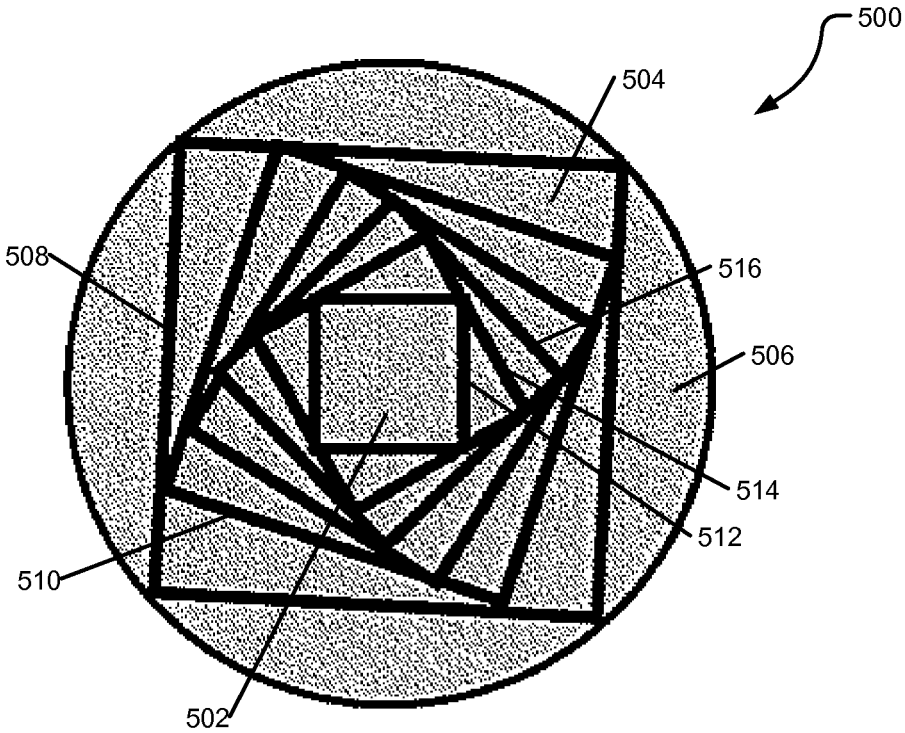

FIG. 5 is a top-down view illustrating a working surface 500 of another coated abrasive article. Surface 500 can include abrasive regions 502, 504, and 506. Additionally, macro-channels 508 and 510 can extend between abrasive regions 502, 504, and 506. Macro-channels 508 and 510 can define a pattern. The pattern can include a plurality of concentric polygons 512 and 514 rotated with respect to one another. In embodiments, the polygons can be regular polygons, such as an equilateral triangle, a square as shown, a pentagon, a hexagon, and other higher order polygons. Polygons 512 and 514 can be rotated by an angle that is not equal to a multiple of the symmetry angle of the polygons. Additionally, at least one vertex of an inner polygon can contact the next larger polygon, such as at an edge of the next larger polygon. As used herein, symmetry angle is defined as the smallest non-zero angle over which the polygon exhibits rotational symmetry. Generally, the symmetry angle is 360° divided by the rotational symmetry order. For example, a square has a rotational symmetry order of four and a symmetry angle of 360°/4=90°.

Figure 6:
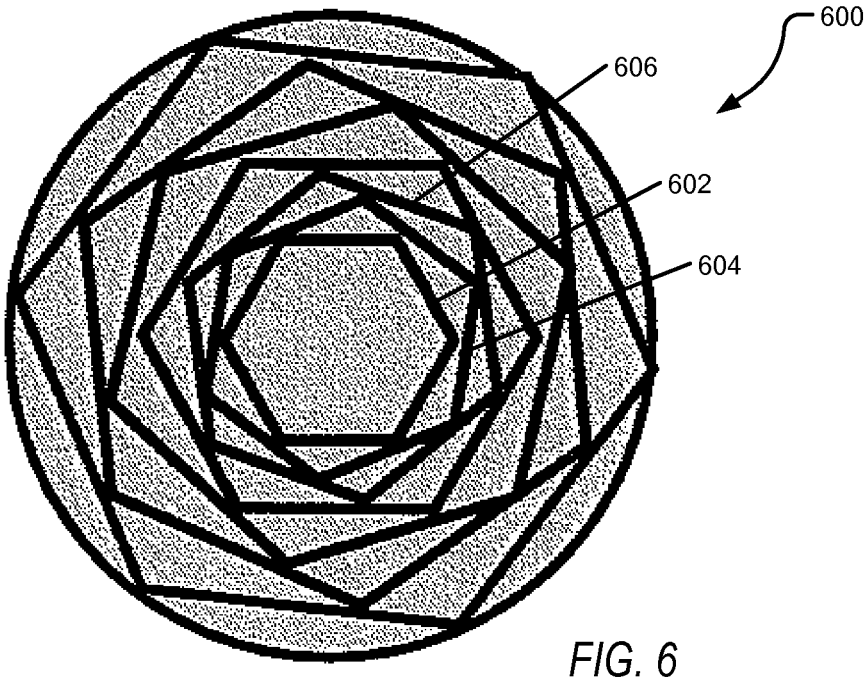

FIG. 6 is a top-down view illustrating a working surface 600 of yet another coated abrasive article having a macro-channel pattern corresponding including a plurality of concentric hexagons 602, 604, and 606.

Returning to FIG. 5, abrasive region 502 can be rectilinear, whereas abrasive regions 504 and 506 can be not rectilinear. Specifically, abrasive region 504 can be an elongate triangular region, and abrasive region 506 can be a circular segment. Generally, the length of the abrasive region can correspond to the length of the longest edge of the abrasive region and an average width of the abrasive regions can be determined by averaging the width measured at each point along the length. In an embodiment, the abrasive regions can have an average width of at least 2.5 microns and not greater than about 50000 microns (50 millimeters). In a particular embodiment, the width of the abrasive regions can be at least about 5000 microns (5 millimeters) and not greater than about 15000 microns (15 millimeters).

In another embodiment, the macro-channels can have openings at the outer contour separated by an angle. As used herein, the angle between the openings corresponds to the angle between line segments extending from the center of the coated abrasives to the center of openings, that is the angle defined by the center of the first opening, the center of the coated abrasive, and the center of the second opening. The angle can be at least about 90°, such as at least about 100°, such as at least about 110°, such as at least about 120°, such as at least about 130°, such as at least about 140°, such as at least about 150°, such as at least about 160°, such as at least about 170°, even about 180°.

Figure 7:
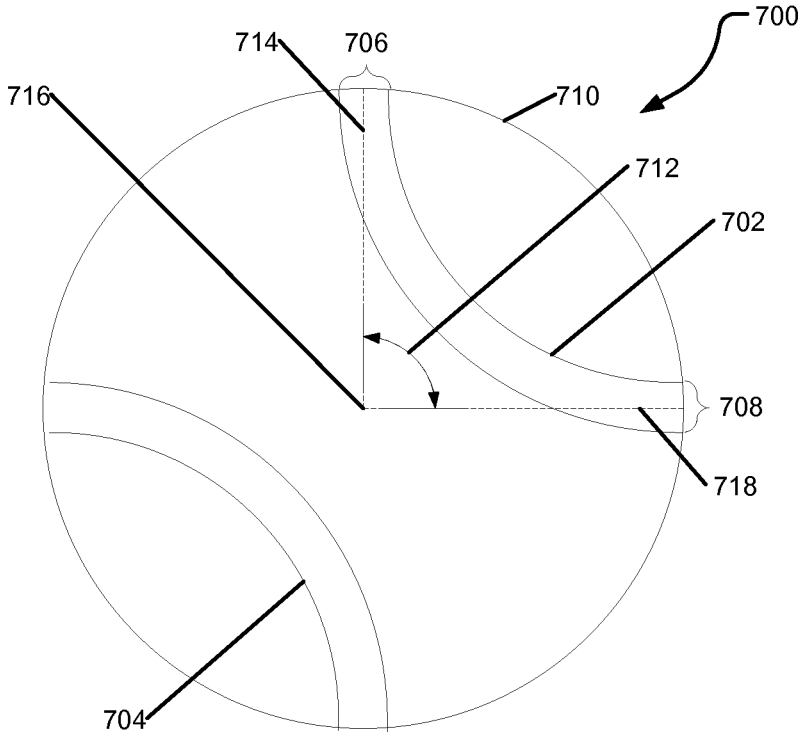

FIG. 7 illustrates a coated abrasive 700 having macro-channels 702 and 704. Macro-channel 702 can have openings 706 and 708 located at the outer edge 710 of coated abrasive 700. Openings 706 and 708 are separated by angle 712 defined by center 714 of opening 706, center 716 of coated abrasive 700, and center 718 of opening 708.

Turning to a method of forming a coated abrasive article, a backing can be paid out from a roll, the backing can be coated with a binder formulation dispensed from a coating apparatus. An exemplary coating apparatus includes a drop die coater, a knife coater, a curtain coater, a vacuum die coater or a die coater. Coating methodologies can include either contact or non contact methods. Such methods include two roll, three roll reverse, knife over roll, slot die, gravure, extrusion or spray coating applications.

In an embodiment, the binder formulation can be provided in a slurry including the formulation and abrasive grains. In an alternative embodiment, the binder formulation can be dispensed separate from the abrasive grains. The abrasive grains may be provided following coating of the backing with the binder, after partial curing of the binder formulation, after patterning of the binder formulation, or after fully curing the binder formulation. The abrasive grains may, for example, be applied by a technique, such as electrostatic coating, drop coating, or mechanical projection.

In another embodiment, the backing, coated with the binder and abrasive grains, can be cut to form abrasive regions and applied to a backpad, such as with an adhesive. The abrasive regions can be arranged on the backpad such that gaps between the abrasive regions form the macro-channels of the abrasive article. The macro-channels can be substantially free of backing material, binder, and abrasive grains.

In another embodiment, the backing can be selectively coated with the binder to leave uncoated regions corresponding to the macro-channels. For example, the binder can printed onto the backing, such as by screen printing, offset printing, or flexographic printing. In another example, the binder can be selectively coated using gravure coating, slot die coating, masked spray coating, or the like. Alternatively, a photoresist or UV curable mask can be applied to the backing and developed, such as by photolithography, to mask portions of the backing. In another example, a dewetting compound can be applied to the backing prior to applying the binder. The dewetting compound can be applied to the regions of the backing corresponding to the macro-channels. The dewetting compound can substantially prevent the binder from binding to the backing, thereby producing macro-channels substantially free of binder and abrasive particles.

In a further embodiment, a pattern can be embossed into the backing. The depressed portions of the pattern can correspond to the macro-channels. Further, binder can be selectively applied to the non-depressed portions of the backing to form the abrasive regions. In an example, a dewetting compound can be applied within the depressed portions.

Turning to a method of abrading a work piece, the work piece can be contacted with a coated abrasive. The coated abrasive can include abrasive regions and macro-channels between the abrasive regions and extending to the edge of the coated abrasive. The coated abrasive can be rotated relative to the work piece. For example, the coated abrasive can be mounted on an orbital sander and contacted to the work piece. While abrading the work piece, material removed from the work piece can accumulate in the macro-channels. The accumulated material can reduce the friction between the work piece and the coated abrasive, causing the rotational speed to increase. At the increased rotational speed, the accumulated material can be ejected from the macro-channels through the openings at the outer edge of the coated abrasive. As the accumulated material is ejected, the friction between the work piece and the coated abrasive can increase, reducing the rotational speed and increasing material removal.

EXAMPLES

Coated abrasive discs are tested by abrading a 6"×24"×3/16" cast acrylic panel. The coated abrasive disc is moved in a straight line across the 24" length of the cast acrylic panel. The material removed is determined by measuring the weight of the cast acrylic panel before and after each grinding cycle using a Mettler Toledo Model #P61003-S Scale. The average material removed is determined by summing the weight loss over six grinds is determined. The average material removal is determined by averaging over three trials.

The surface finish (Ra) of the cast acrylic panel is measured after the first grind using a Mahr M2 Perthometer at three points along the length of the cut. The average Ra is taken over three trials.

Example 1

Example 1 is a comparison of coated abrasive discs having a grit size of P80 (average abrasive grain size of about 200 microns). Each grind of the test is performed for a duration of 2 minutes in the absence of vacuum unless specified otherwise.

Comparative Sample 1 is a Norton A275 5" diameter disc with a P80 grit size. The disc includes no macro-channels and is used without vacuum.

Comparative Sample 2 is a Norton A275 MultiAir 5" diameter disc with a P80 grit size. This disc includes through holes allowing for vacuum removal of material removed from the work piece.

Sample 1 is produced by cutting a Norton A275 6" disc with P80 grit size into 6.35 mm wide strips. The strips are glued to a backpad with a 1.59 mm wide gap between adjacent strips. The backpad with the strips is cut to produce a 5" diameter disc for testing and is used without vacuum.

Sample 2 is produced as Sample 1 except the strips are 9.52 mm wide.

Sample 3 is produced as Sample 1 except the strips are 12.7 mm wide.

Sample 4 is produced as Sample 1 except the gap between adjacent strips is 3.18 mm wide.

Sample 5 is produced as Sample 1 except the strips are 9.52 mm wide and the gap between adjacent strips is 3.18 mm wide.

Sample 6 is produced as Sample 1 except the strips are 12.7 mm wide and the gap between adjacent strips is 3.18 mm wide.

Sample 7 is produced as Sample 1 except the gap between adjacent strips is 4.76 mm wide.

Sample 8 is produced as Sample 1 except the strips are 9.52 mm wide and the gap between adjacent strips is 4.76 mm wide.

Sample 9 is produced as Sample 1 except the strips are 12.7 mm wide and the gap between adjacent strips is 4.76 mm wide.

Table 1 shows the results of the tests using a P80 grit.

TABLE 1

| | Material Removed (g) | Average Ra (micro in) |
|---|---|---|
| Comparative Sample 1 | 14.3 | 86.9 |
| Comparative Sample 2 | 14.6 | 83.9 |
| Sample 1 | 12.4 | 63.2 |
| Sample 2 | 11.6 | 65.6 |
| Sample 3 | 12.4 | 74.8 |
| Sample 4 | 13.2 | 68.0 |
| Sample 5 | 13.8 | 76.3 |
| Sample 6 | 13.1 | 77.1 |
| Sample 7 | 13.9 | 78.1 |
| Sample 8 | 13.6 | 77.2 |
| Sample 9 | 13.2 | 76.1 |

Comparing the different samples, Sample 7 with an abrasive region width of 4.67 mm and a macro-channel width of 4.76 mm results has the highest material removal rate of all of the samples. However, while Sample 7 has a lower material removal rate compared to Comparative Samples 1 and 2, Sample 7 produces a better surface finish than either comparative example.

Example 2

Example 2 is a comparison of coated abrasive discs having a grit size of P320 (average abrasive grain size of about 46 microns). Each grind of the test is performed for a duration of 2 minutes in the absence of vacuum unless specified otherwise.

Comparative Sample 3 is a Norton A275 5" diameter disc with a P320 grit size. The disc includes no macro-channels and is used without vacuum.

Comparative Sample 4 is a Norton A275 MultiAir 5" diameter disc with a P320 grit size. This disc includes through holes allowing for vacuum removal of material removed from the work piece.

Sample 10 is produced by cutting a Norton A275 6" disc with P320 grit size into 6.35 mm wide strips. The strips are glued to a backpad leaving a 1.59 mm wide gap between adjacent strips. The backpad with the strips is cut to produce a 5" diameter disc for testing.

Sample 11 is produced as Sample 10 except the strips are 9.52 mm wide.

Sample 12 is produced as Sample 10 except the strips are 12.7 mm wide.

Sample 13 is produced as Sample 10 except the gap between adjacent strips is 3.18 mm wide.

Sample 14 is produced as Sample 10 except the strips are 9.52 mm wide and the gap between adjacent strips is 3.18 mm wide.

Sample 15 is produced as Sample 10 except the strips are 12.7 mm wide and the gap between adjacent strips is 3.18 mm wide.

Sample 16 is produced as Sample 10 except the gap between adjacent strips is 4.76 mm wide.

Sample 17 is produced as Sample 10 except the strips are 9.52 mm wide and the gap between adjacent strips is 4.76 mm wide.

Sample 18 is produced as Sample 10 except the strips are 12.7 mm wide and the gap between adjacent strips is 4.76 mm wide.

Table 2 shows the results of the tests using a P320 grit.

TABLE 2

| | Material Removed (g) | Average Ra (micro in) |
|---|---|---|
| Comparative Sample 3 | 9.9 | 24.7 |
| Comparative Sample 4 | 13.1 | 28.1 |
| Sample 10 | 11.9 | 27.4 |
| Sample 11 | 12.6 | 26.1 |
| Sample 12 | 13.0 | 26.7 |
| Sample 13 | 13.1 | 26.1 |
| Sample 14 | 13.4 | 28.7 |
| Sample 15 | 13.1 | 27.2 |
| Sample 16 | 12.3 | 26.9 |
| Sample 17 | 12.6 | 27.3 |
| Sample 18 | 12.9 | 27.2 |

Comparing the different samples, Sample 14 with an abrasive region width of 9.52 mm and a macro-channel width of 3.18 mm results has highest material removal rate. However, while Sample 14 has a higher material removal rate compared to Comparative Samples 3 and 4, Sample 14 produces a surface finish between the surface finish of Comparative Examples 3 and 4.

Example 3

Example 3 is a comparison of coated abrasive discs having a grit size of P1500 (average abrasive grain size of about 12.6 microns). Each grind of the test is performed for a duration of 30 seconds in the absence of vacuum unless specified otherwise.

Comparative Sample 5 is a Norton A275 5" diameter disc with a P1500 grit size. The disc includes no macro-channels and is used without vacuum.

Comparative Sample 6 is a Norton A275 MultiAir 5" diameter disc with a P1500 grit size. This disc includes through holes allowing for vacuum removal of material removed from the work piece.

Sample 19 is produced by cutting a Norton A275 6" disc with P1500 grit size into 6.35 mm wide strips. The strips are glued to a backpad leaving a 1.59 mm wide gap between adjacent strips. The backpad with the strips is cut to produce a 5" diameter disc for testing.

Sample 20 is produced as Sample 19 except the strips are 9.52 mm wide.

Sample 21 is produced as Sample 19 except the strips are 12.7 mm wide.

Sample 22 is produced as Sample 19 except the gap between adjacent strips is 3.18 mm wide.

Sample 23 is produced as Sample 19 except the strips are 9.52 mm wide and the gap between adjacent strips is 3.18 mm wide.

Sample 24 is produced as Sample 19 except the strips are 12.7 mm wide and the gap between adjacent strips is 3.18 mm wide.

Sample 25 is produced as Sample 19 except the gap between adjacent strips is 4.76 mm wide.

Sample 26 is produced as Sample 19 except the strips are 9.52 mm wide and the gap between adjacent strips is 4.76 mm wide.

Sample 27 is produced as Sample 19 except the strips are 12.7 mm wide and the gap between adjacent strips is 4.76 mm wide.

Table 3 shows the results of the tests using a P1500 grit.

TABLE 3

| | Material Removed (g) | Average Ra (micro in) |
|---|---|---|
| Comparative Sample 5 | 0.74 | 7.2 |
| Comparative Sample 6 | 1.40 | 7.7 |
| Sample 19 | 1.04 | 5.9 |
| Sample 20 | 1.17 | 6.1 |
| Sample 21 | 1.20 | 6.4 |
| Sample 22 | 1.09 | 6.0 |
| Sample 23 | 1.16 | 6.3 |
| Sample 24 | 1.13 | 6.3 |
| Sample 25 | 1.07 | 6.0 |
| Sample 26 | 1.09 | 5.9 |
| Sample 27 | 1.10 | 6.3 |

Comparing the different samples, Sample 21 with an abrasive region width of 12.7 mm and a macro-channel width of 1.59 mm results has highest material removal rate. While Sample 21 has a higher material removal rate than Comparative Sample 5, Sample 21 has a lower material removal rate than Comparative Sample 6. Further, Comparative Sample 21 has a better surface finish than both Comparative Samples 5 and 6.

When comparing the macro-channel width and abrasive region width for the various grit sizes, it can be observed that as the grain size decreases, performance can be improved by increasing the width of the abrasive region. In addition, as the grain size decreases, performance can be improved by decreasing the macro-channel width. Table 4 shows the ratio of the average channel width to the square root of the average grain size.

TABLE 4

| | Average Grain Size (microns) | Optimal Macro-Channel Width (microns) | Ratio |
|---|---|---|---|
| Sample 7 | 200 | 4760 | 336 |
| Sample 14 | 46 | 3180 | 468 |
| Sample 21 | 12.6 | 1590 | 447 |

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A coated abrasive article comprising:

a backing having a surface, the surface having a shape defined by an outer contour, wherein a bisecting axis divides the shape into first and second portions;

a plurality of abrasive regions directly contacting the surface in each of the first and second portions, each abrasive region including a binder and a plurality of abrasive grains in contact with the binder, the abrasive grains having an average grain size of not greater than about 200 microns;

at least one macro-channel defining a passageway extending between a pair of adjacent abrasive regions and terminating at openings at the outer contour within each of the first and second portions, the macro-channel having an average channel width of between about 0.1 millimeters to about 5 millimeters and being substantially free of the binder and the abrasive grains;

wherein the at least one macro-channel defines a pattern including a plurality of concentric polygons comprising at least a first polygon within a second polygon, the plurality of polygons having the same shape, and each of the plurality of polygons being rotated by an angle with respect to one another, wherein the angle is not equal to a multiple of the symmetry angle of the polygons, and wherein a vertex of the first polygon contacts an edge of the second polygon.

2. The coated abrasive article of claim 1, wherein the macro-channels have a depth of at least about 2.5 microns and not greater than about 2500 microns.

3. The coated abrasive article of claim 1, wherein the abrasive grain has an average size of not greater than about 150 microns.

4. The coated abrasive article of claim 1, wherein the macro-channels extends at least partially into the backing.

5. The coated abrasive article of claim 4, wherein the macro-channels are embossed into the backing.

6. The coated abrasive article of claim 1, wherein the macro-channels have an average width of at least about 0.5 millimeter.

7. The coated abrasive article of claim 1, wherein the macro-channels have a variable width.

8. The coated abrasive article of claim 1, wherein the ratio of the average channel width to the square root of the average grain size is between about 250 to about 750.

9. The coated abrasive article of claim 1, wherein the macro-channels have a rectangular cross section.

10. The coated abrasive article of claim 1, wherein the macro-channels are rectilinear.

11. The coated abrasive article of claim 1, wherein the abrasive regions have an average width of between about 5 millimeters and about 15 millimeters.

12. The coated abrasive article of claim 1, wherein the abrasive regions are elongate triangular regions.

13. The coated abrasive article of claim 1, wherein the shape is a circle, a square, or a rectangle.

* * * * *